United States Patent [19]

Prange

[11] Patent Number: 4,878,517

[45] Date of Patent: Nov. 7, 1989

[54] HIGH PRESSURE HOSE PULSATION ATTACHMENT

[75] Inventor: Charles J. Prange, Cridersville, Ohio

[73] Assignee: Sewer Rodding Equipment Co., Lima, Ohio

[21] Appl. No.: 231,949

[22] Filed: Aug. 15, 1988

[51] Int. Cl.[4] ..... A62C 35/00; B08B 3/00

[52] U.S. Cl. ..... 137/355.12; 137/355.22; 137/355.26; 134/166 C; 134/167 C; 134/168 C

[58] Field of Search ..... 134/168 C, 167 C, 166 C, 134/22.12, 22.18; 242/86, 86.2, 86.5 R; 137/355.12, 355.21, 355.22, 355.26

[56] References Cited

U.S. PATENT DOCUMENTS

| | | | |
|---|---|---|---|
| 3,165,109 | 1/1965 | Hammelmann | 134/167 C |
| 3,522,815 | 8/1970 | Prange | 134/167 |
| 3,585,076 | 8/1968 | Prange | 134/113 |
| 3,600,225 | 8/1971 | Parmelee | 134/10 |
| 3,774,630 | 11/1973 | Prange | 137/355.12 |
| 3,910,497 | 10/1975 | Manor | 134/168 C |
| 4,234,980 | 11/1980 | DiVito et al. | 134/168 C |
| 4,540,017 | 9/1985 | Prange | 137/355.12 |
| 4,576,337 | 3/1986 | Post | 137/355.12 |
| 4,700,422 | 10/1987 | Russell | 134/168 C |

*Primary Examiner*—A. Michael Chambers
*Attorney, Agent, or Firm*—Killworth, Gottman, Hagan & Schaeff

[57] ABSTRACT

A method and apparatus provide for selective generation of pulses at water jets of a jet nozzle terminating a high pressure cleaning hose of a sewer cleaning machine. A ball valve is connected as a pressure bleeder to the high pressure side of the sewer cleaning machine pump and hence, the cleaning hose, for relieving pressure from the hose when the valve is open. A motor is connected to operate a rotatable element of the ball valve to automatically cycle the valve and generate a series of high pressure pulses at the water jets to thereby generate a hammering action to assist in penetration of blockages in a sewer being cleaned. The amplitude of the pulses is controlled by a second valve connected to the ball valve and the pulses preferably are generated at a frequency of approximately 3 hertz. The motor may be activated and deactivated by a blockage sensor which detects engagements of the nozzle with blockages formed by concentrations of refuse and debris within a sewer being cleaned.

8 Claims, 3 Drawing Sheets

HIGH PRESSURE HOSE PULSATION ATTACHMENT

BACKGROUND OF THE INVENTION

The present invention relates generally to sewer cleaning machines wherein cleaning is performed by a high pressure hose terminated by a jet nozzle which pulls the hose through the sewer by rearwardly directed water jets and, more particularly, to a method and apparatus for use in such machines for generating high pressure pulses at the water jets to assist cleaning by pulsating or hammering penetration of blockages formed by concentrated accumulations of refuse and debris.

High pressure water flushing is a recognized effective way of cleaning both storm and sanitary sewers. In such sewer cleaning systems, a length of hose is unwound from a reel carried on a truck with the hose being inserted into a sewer to be cleaned. The end of the hose carries a jet nozzle which pulls itself and the hose through the sewer by the force of its rearwardly directed high pressure water jets which, at the same time, wash debris in the sewer back toward the cleaning entryway. The reel is rotated by a motor which is controlled by an operator of the cleaning system such that the hose is fed out at a rate consistent with its progress through the sewer. After the nozzle has traveled for a distance through the sewer, the motor connected to the reel is reversed to rewind the hose into the reel. This process is repeated several times until the length of sewer is clean.

As the nozzle pulls and advances the hose through the sewer, the nozzle may encounter a blockage caused by the collection of a substantial amount of refuse and debris which blockage momentarily hinders the advancement of the hose. It has been recognized that pulsation of the high pressure water within the hose creates a pulsating or hammering action at the nozzle to assist in the penetration of blockages within sewers. One approach to obtaining hammering action is to use a single piston high pressure pump as opposed to a three piston pump. A single piston pump inherently and continuously generates high amplitude pulsations at a frequency of approximately 1 hertz as opposed to a three piston pump which provides a substantially constant high pressure to the hose. Unfortunately, the continuous hammering action created by a single piston pump can lead to premature failure of the sewer cleaning system.

Another approach to obtaining pulsating or hammering action is to provide a hand operated valve on the pressure side of a high pressure pump used to operate a sewer cleaning system. This valve bleeds the cleaning fluid back to the holding tank or other source for the fluid. By manually throwing a lever which controls the valve, a single pulse is introduced at the hose nozzle because of the opening and closing of the valve such that high pressure pulses can be manually introduced by the machine operator. While this approach prevents the continuous hammering action which can lead to early deterioration of the cleaning system, to be effective it requires concentration on the part of the operator to determine when a blockage has been encountered by the nozzle and then the repeated operation of the control lever for the bleeder valve until the blockage has been penetrated.

Accordingly, there is a need for a method and apparatus for selectively generating a pulsating or hammering action at the nozzle of a high pressure sewer cleaning hose which is not demanding on an operator of the system and, preferably, is automatically activated upon the nozzle encountering a blockage in a sewer such that it not only relieves the cleaning system operator of tedious duties but also is not dependent for its activation upon the attentive observations of the operator.

SUMMARY OF THE INVENTION

In accordance with the present invention, a method and apparatus provide for selectively generating pulsations at the jet nozzle of a high pressure hose which forms a part of a sewer cleaning machine. The invention provides for selective and, preferably, automatic activation of the pulsations when the nozzle engages a blockage formed by concentrated accumulations of refuse and debris to generate a hammering action to assist the nozzle and hose in penetrating the blockage. Since the pulsating or hammering action is activated only when needed to penetrate blockages, premature deterioration of the cleaning machine, characteristic of continuous pulsating or hammering action, is avoided. In contrast to the high amplitude/harsh pulsations of the continuous prior art system, which pulsates at a frequency of approximately 1 hertz, the present invention provides for a reduced and selective amplitude of pulsations and at a higher frequency of approximately 3 hertz.

Advantageously, when the present invention is incorporated into a new sewer cleaning machine or retrofitted into an existing machine, a single activation control switch leads to the generation of a series of selected amplitude high pressure pulses at the water jets of the nozzle such that the repeated manual operations or the continuous pulsations of the prior art are avoided. Further, if the sewer cleaning machine which incorporates the high pressure hose pulsating attachment of the prsent invention includes or can be made to include an arrangement for sensing when the nozzle engages a blockage, that sensing arrangement can be used to automatically activate the pulsations upon engaging a blockage and deactivate the pulsations upon penetration of that blockage. In this regard, the high pressure hose pulsation attachment of the present invention is particularly applicable to equipment made in accordance with the teachings and disclosure of U.S. patent application Ser. No. 151,197 entitled Sewer Cleaning Equipment which was filed by the inventor of the present application on Feb. 1, 1988, is assigned to the same assignee as the present application and is hereby incorporated by reference.

In accordance with one aspect of the present invention, apparatus for use in a sewer cleaning machine wherein cleaning is performed by a high pressure hose terminated by a jet nozzle which pulls the hose through the sewer by rearwardly directed water jets comprises pressure bleeder means connected to the hose for relieving the high pressure developed therein and including first valve means for operating the pressure bleeder means. Pulse control means automatically cycle the first valve means to generate a series of high pressure pulses at the water jets to generate a pulsating or hammering action which assists in cleaning by better penetrating blockages formed by concentrated accumulations of refuse and debris. Switch means are provided for selectively activating and deactivating the pulse control means such that repeated manual operations or continuous pulsating operation is avoided. The pressure bleeder means preferably further comprises second valve means for selectively controlling the amplitude of the series of high pressure pulses generated at the water jets.

The sewer cleaning machine incorporating the present invention may also include sensor means for detecting engagement of the jet nozzle with blockages formed by concentrated accumulations of refuse and debris. If so, the switch means is connected to the sensor means for automatic activation and deactivation of the pulse control means as the jet nozzle engages and penetrates blockages, respectively. The first valve means may be a ball valve including a rotatable control element and the pulse control means then may comprise a motor connected to rotate the control element of the ball valve to generate the series of high pressure pulses at the water jets.

To ensure proper operation of the sewer cleaning machine incorporating the high pressure hose pulsation attachment of the present invention, the switch means preferably comprises shut-off control means for deactivating the pulse control means such that pressure is maintained in the high pressure hose. The shut-off control means may comprise a proximity switch and an activating element coupled to the motor such that the activating element is positioned adjacent the proximity switch when the ball valve is closed to maintain pressure in the high pressure hose. Alternately, the shut-off control means may comprise a switch including an operating lever, an operating cam for engaging the operating lever with the cam being coupled to and operated by the motor such that the cam engages the operating lever when the ball valve is closed to maintain pressure in the high pressure hose.

In accordance with another aspect of the present invention, a method for operating a sewer cleaning machine wherein cleaning is performed by a high pressure hose terminated by a jet nozzle which pulls the hose through the sewer by rearwardly directed water jets comprises the steps of: (a) maintaining a substantially constant high pressure supply of cleaning fluid for the hose; (b) providing a pressure bleeder valve for relieving the high pressure within the hose: (c) automatically, cyclically operating the pressure bleeder valve to generate a series of high pressure pulses at the water jets; and (d) selectively performing step (c) when blockages formed by concentrated accumulations of refuse and debris are detected to assist in cleaning by generating a pulsating. hammering action to better penetrate such blockages. The method may further comprise the step of (e) controlling the amplitude of the high pressure pulses generated at the water jets. To remove drudgery from the operator of the system incorporating the present invention, the method may also further comprise the step of (f) automatically detecting blockages to control the selective performance of step (c).

It is therefore a primary object of the present invention to provide a method and apparatus for operating both new and existing sewer cleaning machines which perform their cleaning operations by means of a high pressure hose terminated by a jet nozzle which pulls the hose through the sewer by rearwardly directed water jets by automatically generating a series of high pressure pulses at the water jets, with the generation of such pulses being selectively activated and deactivated, to assist in cleaning by better penetrating blockages formed by concentrated accumulations of refuse and debris.

It is another object of the present invention to provide a method and apparatus for operating new and existing sewer cleaning machines which perform their cleaning operations by means of a high pressure hose terminated by a jet nozzle which pulls the hose through the sewer by rearwardly directed water jets by sensing when the nozzle engages blockages formed by concentrated accumulations of refuse and debris and automatically generating a series of high pressure pulses at the water jets to penetrate the blockages with the pulses being deactivated once the blockages are penetrated.

It is yet another object of the present invention to provide a method and apparatus for operating new and existing sewer cleaning machines which perform their cleaning operations by means of a high pressure hose terminated by a jet nozzle which pulls the hose through the sewer by rearwardly directed water jets wherein a series of high pressure pulses are generated at a frequency of approximately 3 hertz and the amplitude of those pulses can be selected to assist in cleaning by better penetrating blockages formed by concentrated accumulations of refuse and debris.

Other objects and advantages of the invention will be apparent from the following description, the accompanying drawings and the appended claims.

DETAILED DESCRIPTION OF THE INVENTION

Figure 1:
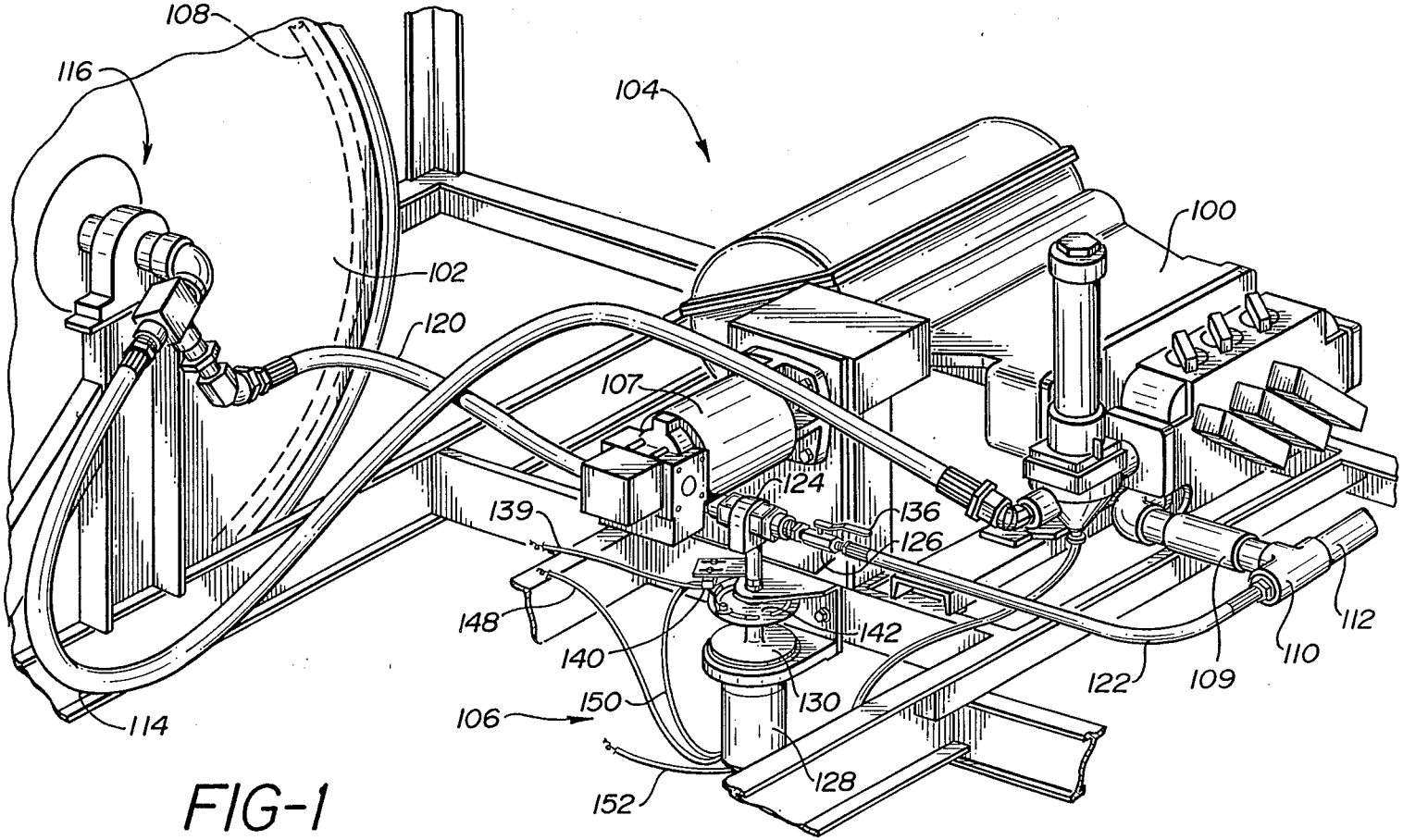
FIG. 1 is a perspective view of a high pressure pump and hose reel portion of a mobile sewer cleaning machine incorporating a high pressure hose pulsation attachment operable in accordance with the present invention.
Figure 2:
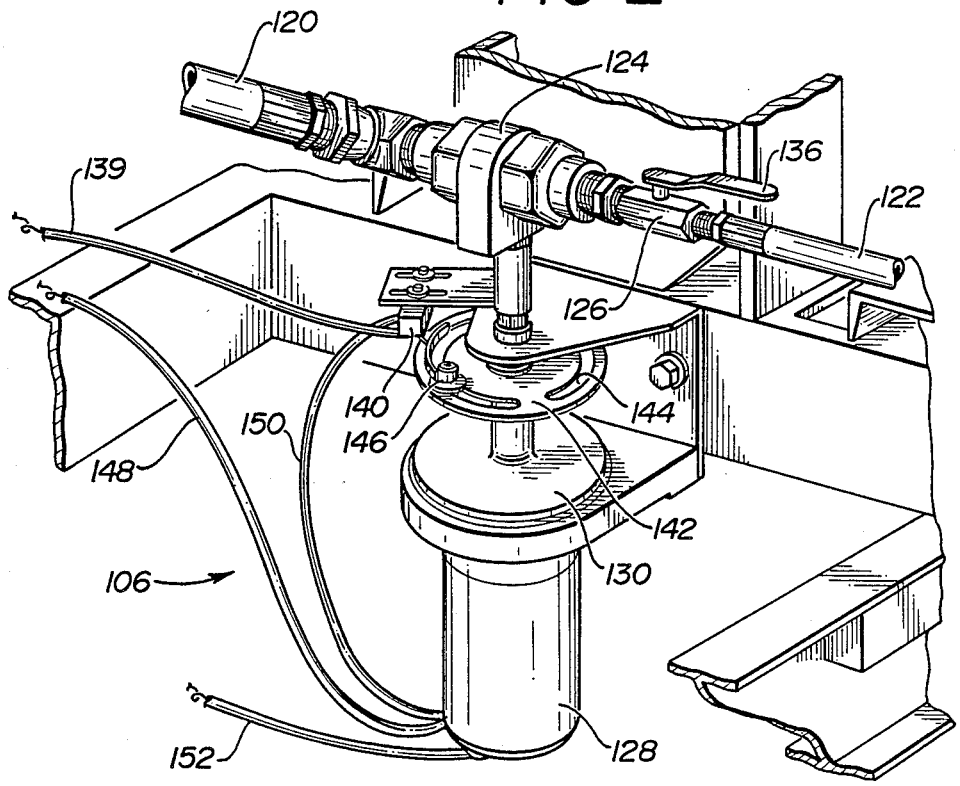
FIG. 2 is a perspective view of the high pressure hose pulsation attachment of FIG. 1 shown on an enlarged scale.

FIG. 1 is a perspective view of a high pressure pump 100 and a hose reel 102 portion of a mobile sewer cleaning machine 104 incorporating a high pressure hose pulsation attachment 106 operable in accordance with the present invention and also shown in FIG. 2 on an enlarged scale. The high pressure pump 100 is a triplex, three piston pump which is driven by a hydraulic motor 107 to provide a substantially constant, extremely high pressure, on the order of 2,000 psi, supply of cleaning fluid, normally water, for a high pressure cleaning hose 108 which is wound around the hose reel 102. Water is drawn into the pump 100 through a pipe 109 which is connected to a water holding tank (not shown) or other source of cleaning fluid through a T-connection 110 and a water entry pipe 112.

After being highly pressurized by the pump 100, the water is ejected through a high pressure feeder hose 114 which passes the water to the high pressure cleaning hose 108 through a manifolding arrangement generally indicated by the numeral 116. The pressure developed within the high pressure feeder hose 114 and hence the cleaning hose 108 can be relieved by pressure bleeder means comprising a bleeder hose 120 which is connected to a water return pipe 122 through a first valve means comprising a ball valve 124 and a second valve means comprising a manually actuated valve 126. The return pipe 122 is in turn connected to the pipes 109 and 112 through the T-connection 110.

Pulse control means is provided for automatically cycling the ball valve 124 to generate a series of high pressure pulses in the cleaning hose 108 and hence at the water jets of the jet nozzle (not shown) which terminates the high pressure hose. This series of pulses assists sewer cleaning by generating a pulsating/hammering action to better penetrate sewer blockages formed by concentrated accumulations of refuge and debris. In the illustrated embodiment, the pulse control means comprises a motor 128 which is connected to rotate a rotatable control element (not shown) inside the ball valve 124. The motor 128 includes a gearing arrangement 130 such that when the motor 128 is operated, it rotates the control element of the ball valve 124 at a frequency of approximately 3 hertz. Of course it should be apparent that motor speed and gearing may be adjusted to provide pulsations at any reasonable frequency which is desired.

Switch means comprising a toggle switch 132 or 134 as shown in the schematic diagrams of FIGS. 3 and 4, respectively, provides for selectively activating and deactivating the motor 128 as will be described hereinafter with reference to those drawing figures. The second valve means comprises the manual valve 126 which includes a manual operating handle 136 which permits the operator of the sewer cleaning system to select the amplitude of the series of high pressure pulses generated in accordance with the method and apparatus of the present invention.

Figure 3:
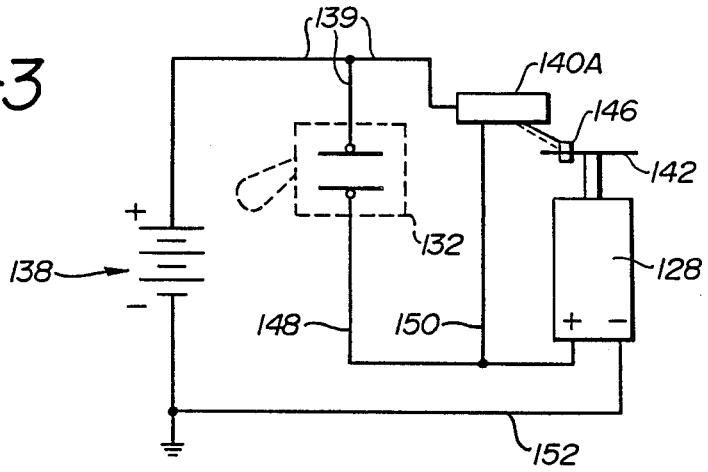
FIG. 3 is an electrical schematic diagram showing manual operation of the high pressure hose pulsation attachment of the present invention.

A circuit for manual operation of the high pressure hose pulsation attachment of the present invention is shown by the electrical schematic diagram of FIG. 3. A battery 138 is connected to one side of the toggle switch 132 by means of a wire 139 which also connects the positive side of the battery 138 to a proximity switch 140 as shown in FIGS. 1 and 2, a microswitch 140A as shown in FIGS. 3 and 4, or other appropriate electrical switch. The proximity switch 140 or microswitch 140A is connected to provide shut-off control means such that the ball valve 124 is moved to its closed position to maintain pressure in the high pressure feeder hose 114 and hence the cleaning hose 108 when the pulse control means is deactivated to stop the pulsating or hammering action such that water at a substantially constant pressure is passed to the cleaning hose 108.

For operation of the shut-off means, a disk 142 is coupled to the driving shaft of the motor 128 beyond the gearing arrangement 130. A slot 144 is formed a substantial distance around the disk 142 for receiving a bolt 146 which can be selectively secured along the slot 144 to serve as an activating element for the proximity switch 140 or a cam element if the microswitch 140A is used in the shut-off control means. The bolt 146 is positioned such that it activates either the proximity switch 140 or the microswitch 140A when the ball valve 124 is in its closed position. Referring once again to FIG. 3, the toggle switch 132 is connected to the positive terminal of the motor 128 by means of a wire 148 and the microswitch 140A (or proximity switch 140) is also connected to the positive terminal of the motor 128 by means of a wire 150. The negative terminal of the motor 128 is connected to ground or the negative side of the battery 138 via a wire 152.

From a review of the schematic diagram of FIG. 3 and the illustrations of FIGS. 1 and 2, it can be seen that the high pressure hose pulsation attachment of the present invention is activated by operating the toggle switch 132 such that power is passed from the battery 138 to the positive terminal of the motor 128 causing it to commence rotating the control element of the ball valve 124 at a rate of approximately 3 hertz. The operator can adjust the handle 136 of the manual valve 126 to obtain the amplitude of pulses desired which are maintained as long as the toggle switch 132 is operated to connected power to the motor 128.

Once a blockage has been penetrated by the pulsating/hammering action created by the series of high pressure pulses, the switch 132 can be moved to the off position removing power from the wire 148. However, to ensure that pressure is maintained in the high pressure feeder hose 114 and hence the cleaning hose 108 after the attachment is deactivated, power from the battery 138 is maintained through the proximity switch 140 (or the microswitch 140A) until the bolt 146 is in a position to operate the proximity switch 140 (or the microswitch 140A). This positioning of the bolt 146 defines the closed position of the ball valve 124 and removes power from the motor 128 at a time such that the ball valve 124 is in its closed position when the pulsating operation is deactivated.

A sewer cleaning machine incorporating the high pressure hose pulsation attachment of the present invention may also include sensor means for detecting engagement of the jet nozzle of the high pressure hose 108 with blockages formed by concentrated accumulations of refuse and debris. If so, the switch means is connected to the sensor means for automatic activation and deactivation of the pulse control means as the jet nozzle engages and penetrates blockages, respectively. A circuit for automatic operation of the high pressure hose pulsation attachment of the present invention is shown by the electrical schematic diagram of FIG. 4.

In accordance with the teachings of referenced U.S. patent application Ser. No. 151,197, engagements of the jet nozzle of the cleaning hose 108 with blockages are detected by sensing a slack loop of the hose 108 which will develop if the motor operating the reel 102 is operated at a rate faster than the hose 108 can advance in the sewer. One embodiment of such a sensing means includes optical sensing and comprises a photo-optical detector 160 and a reflector 162 mounted on the floor of a compartment which houses the reel 102. The photo-optical detector 160 produces a light beam 164 which is reflected back by the reflector 162 to the detector 160 if the cleaning hose 108 is advancing through the sewer being cleaned. As shown in FIG. 4, the detector 160 and reflector 162 are positioned beneath the reel 102 and the hose 108 such that the path of the light beam 164 is interrupted by a desending slack loop of the hose 108 if it unravels from the reel 102.

Figure 4:
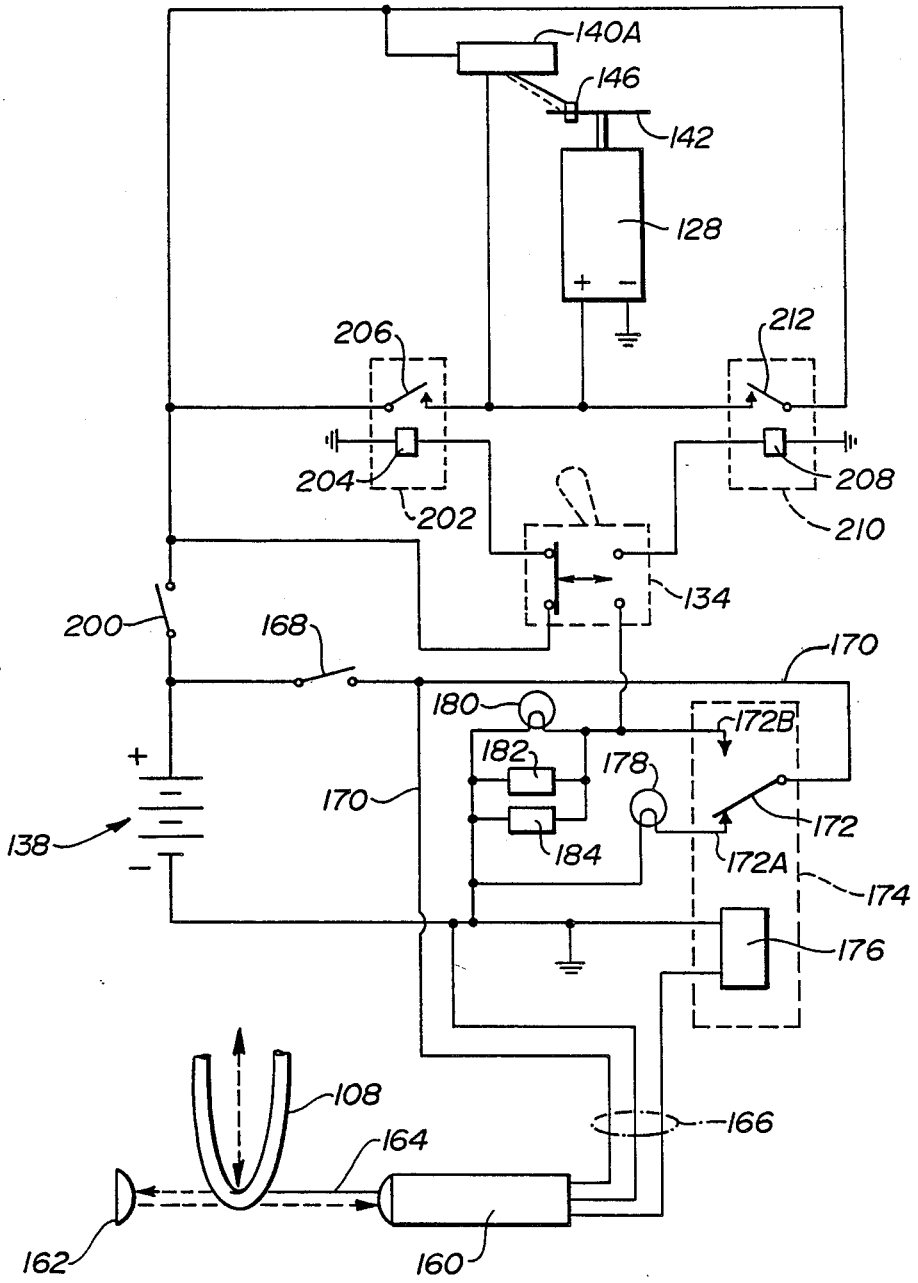
FIG. 4 is an electrical schematic diagram showing automatic operation of the high pressure hose pulsation attachment of the present invention which activates the attachment upon engagement of a blockage and deactivates the attachment once the blockage has been penetrated.

The detector 160 is connected via a cable 166 to additional circuitry shown in FIG. 4. The positive terminal of a battery 138 is connected through a normally open switch 168 to a wires 170 which are connected to the detector 160 and the common terminal of a double pole switch 172 of a relay 174. The negative terminal of the battery 138 is also connected to the detector 160 and one side of the coil 176 of the relay 174 with the other side of the coil 176 being connected to the detector 160.

A green lamp 178 is connected to the first pole 172A of the double pole relay switch 172 and to the negative terminal of the battery 138. A red lamp 180 is connected in parallel with a buzzer 182 and a hydraulic dump valve 184 to the second pole 172B of the double pole relay switch 172 and the negative terminal of the battery 138.

In operation the high pressure hose 108 progresses through a sewer performing its cleaning operation as a motor operates the reel 102 to unreel the hose 108. As long as a desending loop does not form in the hose 108, the sensing means provides no signal to energize the coil 176 of the relay 174. As a result the switch 172 is in its normal position providing a current path through the first pole 172A to illuminate the green light 178 as an indication to the operator that the hose 108 is moving uninpeded through a sewer being cleaned.

If the nozzle of the cleaning hose 108 encounters a blockage formed by a substantial accumulation of refuse and debris and the motor continues to advance the reel 102 to feed the hose 108 therefrom, a descending loop of the hose 108 will be formed, as shown in FIG. 4, to activate the sensing means comprising the detector 160 or other appropriate sensing means to generate a stop signal which energizes the coil 176 of the relay 174 to move the position of the switch 172 to its second pole 172B. As a result, the green light 178 is turned off and a red light 180 and the buzzer 182 are energized so that the operator is given a visible and audible warning that the hose 108 is unraveling from the reel 102.

Even if the operator is not present, the switch 172 causes the hydraulic dump valve 184 to be activated which automatically stops the rotation of the reel 102 by diverting the flow of hydraulic fluid from the motor (not shown) operating it. Once the blockage is penetrated and a descending loop of the cleaning hose 108 is removed from the sensing path of the detector 160, the reel 102 is once again operated to feed the hose 108 therefrom. In addition to the advantages provided by the automatic sensing of blockages as described in reference U.S. patent application Ser. No. 151,197, which should be consulted if more information is desired regarding the sensing system, the blockage sensor may also be utilized in accordance with the present invention for automatic activation and deactivation of the pulse control means as the jet nozzle of the high pressure hose 108 engages and penetrates blockages, repsectively.

The intercoupling and cooperative operation of the blockage sensing arrangement just described with the high pressure hose pulsation attachment of the present invention will now be described with further reference to FIG. 4. Operation of the high pressure hose pulsation attachment is enabled by a power switch 200 which connects the positive terminal of the battery 138 to the circuitry of the attachment. The system will manually operate if the three way toggle switch 134 is moved to the positioned shown in FIG. 4 wherein the left two internal terminals of the switch 134 are closed. In this position of the switch 134, closure of the power switch 200 activates the solenoid 202 via its operating coil 204. Activation of the solenoid 202 closes its normally open contact 206 to connect power to the positive terminal of the motor 128. In this manual operating mode, the pulsation attachment operates as previously described with reference to FIG. 3.

For the preferred automatic operation of the pulsation attachment upon the sensing of blockages encountered within a sewer being cleaned, the three way toggle switch 134 is moved to connect the right two terminals of the switch 134 such that contact 172B of the relay 174 is connected to a coil 208 of a solenoid 210. In accordance with the description of the operation of the blockage sensing arrangement herein and in referenced patent application Ser. No. 151,197, if a blockage is detected such that the relay 174 is operated by activation of its coil 176, the coil 208 of the solinoid 210 is also activated to close its contacts 212. Closure of the contacts 212 connects electrical power to the positive terminal of the motor 128 thus activating the high pressure hose pulsation attachment of the present invention.

Once the blockage is penetrated and the loop of the high pressure hose 108 is raised above the detector 160 and the relay 174 is released, the solenoid 210 is also released to open its contact 212 to remove the primary power supply from the motor 128. Here again the shutoff feature provided by the microswitch 140A (or proximity switch 140 operates to ensure that the pulsation attachment is deactivated in a position wherein the ball valve 124 is closed to maintain pressure in the high pressure cleaning hose 108 for continued operation of the sewer cleaning system.

While the method herein described and the forms of apparatus for carrying this method into effect constitute preferred embodiments of the invention, it is to be understood that the invention is not limited to the precise method or forms of apparatus and that changes can be made in either without departing from the scope of the invention which is defined in the appended claims.

What is claimed is:

1. Apparatus for use in a sewer cleaning machine wherein cleaning is performed by a high pressure hose terminated by a jet nozzle which pulls the hose through the sewer by rearwardly directed water jets, said apparatus comprising:

pressure bleeder means connected to the hose for relieving the high pressure developed therein including first valve means for operating said pressure bleeder means;

pulse control means for automatically cycling said first valve means to generate a series of high pressure pulses at the water jets to assist in cleaning by better penetrating blockages formed by concentrated accumulations of refuse and debris; and switch means for selectively activating and deactivating said pulse control means.

2. Apparatus for use in a sewer cleaning machine as claimed in claim 1 wherein said pressure bleeder means further comprises second valve means for selectively controlling the amplitude of said series of high pressure pulses generated at the water jets.

3. Apparatus for use in a sewer cleaning machine as claimed in claim 1 wherein said sewer cleaning machine includes sensor means for detecting engagement of said jet nozzle with blockages formed by concentrated accumulations of refuse and debris, and said switch means is connected to said sensor means for automatic activation and deactivation of said pulse control means as said jet nozzle engages and penetrates said blockages, respectively.

4. Apparatus for use in a sewer cleaning machine as claimed in claim 1 wherein said first valve means is a ball valve including a rotatable control element, and said pulse control means coprises a motor connected to rotate the control element of said ball valve to generate said series of high pressure pulses at the water jets.

5. Apparatus for use in a sewer cleaning machine as claimed in claim 4 wherein said switch means comprises shut-off control means for deactivating said pulse control means such that pressure is maintained in said high pressure hose.

6. Apparatus for use in a sewer cleaning machine as claimed in claim 5 wherein said shut-off control means comprises a proximity switch, and an element for activating said proximity switch when positioned adjacent thereto, said activating element being coupled to and operated by said motor such that said element is moved adjacent to said proximity switch when said ball valve is closed such that pressure is maintained in said high pressure hose.

7. Apparatus for use in a sewer cleaning machine as claimed in claim 5 wherein said shut-off control means comprises a switch including an operating lever, and an operating cam for engaging said operating lever, said cam being coupled to and operated by said motor such that said cam engages said operating lever when said ball valve is closed such that pressure is maintained in said high pressure hose.

8. Apparatus for use in a sewer cleaning machine as claimed in claim 1 wherein said series of high pressure pulses occur at a frequency of approximately 3 hertz.

* * * * *